US007831167B2

(12) United States Patent
Huber et al.

(10) Patent No.: US 7,831,167 B2
(45) **Date of Patent: *Nov. 9, 2010**

(54) HANDICAP ACCESSIBLE REMOVABLE CONTROL PANEL

(75) Inventors: Scott M. Huber, Canandaigua, NY (US); Dawn M. Hess, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 792 days.

This patent is subject to a terminal disclaimer.

(21) Appl. No.: 11/823,550

(22) Filed: Jun. 28, 2007

(65) Prior Publication Data

US 2009/0002954 A1 Jan. 1, 2009

(51) Int. Cl.
*G03G 15/00* (2006.01)

(52) U.S. Cl. ..... 399/81; 399/107

(58) Field of Classification Search ..... 399/81, 399/107, 110; 715/740

See application file for complete search history.

(56) References Cited

U.S. PATENT DOCUMENTS

| | | | | |
|---|---|---|---|---|
| 5,138,384 | A * | 8/1992 | Mizutani et al. | 399/183 |
| 5,543,897 | A * | 8/1996 | Altrieth, III | 399/81 |
| 5,870,647 | A * | 2/1999 | Nada et al. | 399/18 |
| 6,748,186 | B1 * | 6/2004 | Skrainar et al. | 399/81 |
| 7,667,685 | B2 * | 2/2010 | Yamada et al. | 345/156 |
| 7,693,449 | B2 * | 4/2010 | Kaseno et al. | 399/107 |
| 2006/0204253 | A1 * | 9/2006 | Mae et al. | 399/16 |
| 2008/0219689 | A1 * | 9/2008 | Lang et al. | 399/81 |

* cited by examiner

*Primary Examiner*—David M Gray
*Assistant Examiner*—Rodney Bonnette
(74) *Attorney, Agent, or Firm*—Prass LLP

(57) ABSTRACT

This invention involves a control panel that is removable from a marking machine housing. This removable control panel is used to lower or raise the entire marking machine or just a module or modules of the machine. Wheelchair users have difficult times using a conventional marking machine such as a copier or printer. The user with the removable control panel can lower the entire machine so that access to all components is possible. In addition, the wheelchair user can raise the paper trays to be side by side with the processor module. It is important that the copier raise-lower function be on the control panel in addition to a control for horizontal movement of the module(s). Any other function can be put on the control panel.

5 Claims, 5 Drawing Sheets

HANDICAP ACCESSIBLE REMOVABLE CONTROL PANEL

The present invention relates to office products including marking systems and, more specifically, to a control panel for said systems for use by handicapped or disabled persons.

Illustrated and disclosed in co-pending application ID 20071156 entitled "Handicapped Accessible Office Products" and owned by the same assignee as the present application is material relating to use of a marking machine by handicapped people. In ID 20070156, material is disclosed on the use of vertical and horizontally movable modules to permit wheelchair users to access functions of a marking machine. ID 20070156 and the present application ID 20070156Q are filed concurrently herewith. The disclosure of ID 20070156 is totally incorporated herein by reference.

BACKGROUND

While the control panel of this invention can be considered for multiple uses in various areas, embodiments of the present invention for clarity will be described in relation to an electrostatic marking system and modules useful therein. It should be understood, however, that usage in systems other than electrostatic marking systems are intended to be included within the spirit of this invention.

In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development, the toner particles are attracted from the carrier particles by the charge pattern of the image areas on the photoconductive insulating area to form a powder image on the photoconductive insulating area to form a powder image on the photoconductive area. This image may be subsequently transferred to a support surface such as copy paper to which it may be permanently affixed by heating or by the application of pressure. Following transfer of the toner image to the to the support surface, the photoconductive insulating surface may be discharged and cleaned of residual toner to prepare for the next imaging cycle. This defined electrostatic system and reproducing apparatus is known as the Image Output Terminal (I.O.T.) or processor module.

When handicapped people in wheelchairs use office equipment such as electrostatic marking systems, certain difficulties have been observed. The height of the printer (or copier or fax) makes it difficult for the handicapped person to reach many components including the top platen glass. The low paper tray locations below the Image Output Terminal (hereinafter I.O.T.) or processor module make it almost inaccessible to handicapped people who have trouble bending down or stretching. Even just placing an original document on top of the platen can be a difficult task for people in wheelchairs, etc. Today, it is virtually impossible for a person in a wheelchair to access all copier functions including the document handler or paper trays that need to be frequently loaded.

SUMMARY

Paper trays for some marking systems and products are located under the processor module or I.O.T. If the paper trays were located to the side of the unit, the unit would have approximately two feet below that could accommodate height adjusters that provide automatic (as opposed to manual means) adjusting means such as a power driven scissors-jack or a hydraulic lift can be used. These adjusting means could be controlled by a removable control panel so that a disabled person could lower the machine to reach the document handler or the glass platen top or any machine component that is located on the upper part and lower part of the machine. The paper trays would be more easily accessible for a handicapped person if they were brought up to the current level of the I.O.T. and located to the side of the I.O.T. With a removable control panel, the wheelchair user can fully operate the marking system from his or her chair. The machine modules such as the processor module and paper tray module can be moved vertically and horizontally to a convenient position merely by manipulating the removable control panel. The control panel is originally removably positioned in the side (or other section) of the marking machine. By pressing a release button, the control panel can be dislodged from the machine and used remotely by the wheelchair user. A plurality of control buttons or items are put into the panel for various functions such as raising or lowering any module or moving any module horizontally. In this way, each machine function will be much more accessible for handicapped persons. The paper trays would be moved by the panel adjacent to the processor module side by side for easier access especially for persons in wheelchairs. The panel would also provide control of a further enhancement, i.e. height adjusters such that the height would be optimal for paper loading and for platen glass height or document handler height. The height of both the I.O.T. and the paper trays and other functions would be automatically adjustable by this wireless or hard-wired removable panel. Also, the entire unit(s) or modules can be moved by the removable panel horizontally as well as vertically as shown in the drawings. A scissors-jack mechanism with electric motor or a hydraulic lift or any other suitable lifting and lowering device can be controlled by buttons on the removable panel.

The panel, after removal from the machine, is turned on by pressing an on-off button. A remote control sensor is located at a convenient portion of the panel to make electrical or optical contact with a receiver element in the machine. While it is necessary that the control panel always have a module raise-lower button, as an optional horizontal move button, other button features can be optionally placed on the panel such as darker or lighter images, reduce and enlarging functions. Finishing functions such as gluing and stapling, etc. can also be placed on the removable panel.

"Components" as used in this disclosure means parts of the system. "Modules", however, does not mean the same as "components"; "Modules" mean throughout this disclosure functional units of the marking structure such as an I.O.T. module, a paper tray module, a finisher module, etc. The vertical and horizontal adjusters and the removably control panel are "components" and not "modules". "Modules" generally can also be "components". All of the modules in the present embodiments are also components; however all components are not modules.

DETAILED DISCUSSION OF DRAWINGS AND PREFERRED EMBODIMENTS

Figure 1:
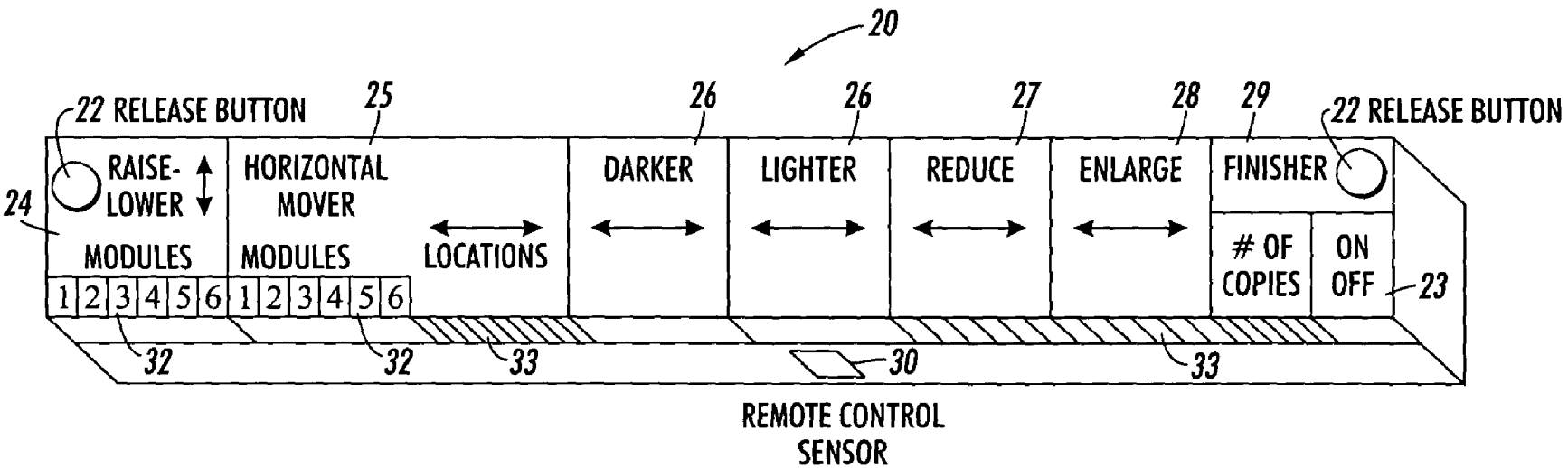
FIG. 1 illustrates an embodiment of a removable control panel of this invention.

In FIG. 1, an embodiment of a removable control panel 20 of this invention is shown. The panel 20 is originally located in the machine module or modules 3 or 4 at locations 21 but is easily dislodged or removed merely by pressing release buttons 22. Once removed from I.O.T. module 3 or paper module 4, the panel 20 is turned on by pressing on/off button 23. Any number of different functions can be designated on the panel 20, however, the raise-lower button 24 and the horizontal mover button 25 must be provided in order for the wheelchair user to move the modules and have easy access to all marking machine functions. Other controls such as type of paper, darker-lighter copies 26, reduce copy 27, enlarge copy 28 and finisher control 29 may optionally be used. Obviously, any suitable function may be provided in the removable panel. A remote control sensor 30 is provided in the front (or any other location) of the removable panel and the receiver 31 to communicate with sensor 30 is located at any location in the module such as in the space 21 vacated when the panel 20 is removed from the module. The module numbers 32 to indicate such as 1 for the I.O.T. module, 2 for the paper tray function, etc. may be used for convenient moving of any module. Also, designations increments 33 can be used for locations, reduce image size, enlarge image size or any other designation.

Functions and operations that are convenient and easy for non-handicapped present a problem to people in a wheelchair such as starting the copier, using the platen, lifting the platen cover, loading the paper trays, retrieving copies, feeding multiple copies, etc. The removable control panel, together with the ability to raise or lower modules, helps solve this problem.

Figure 2:
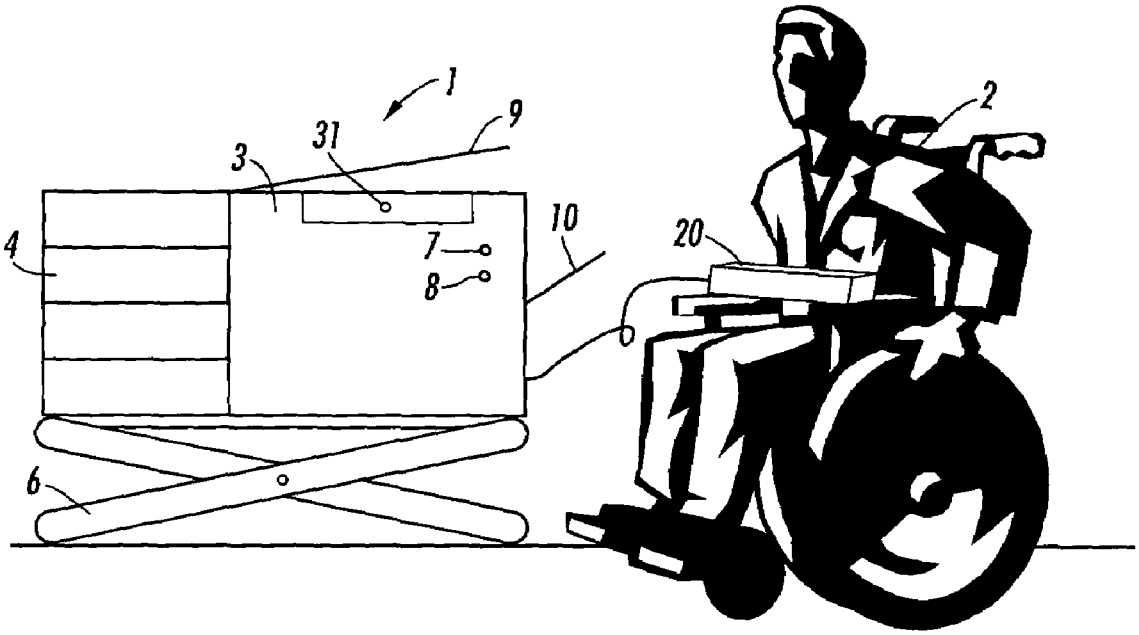
FIG. 2 illustrates a side view of a scissors-jack lift embodiment of this invention with a location of the removable panel on the upper side of the processor module.
Figure 3:
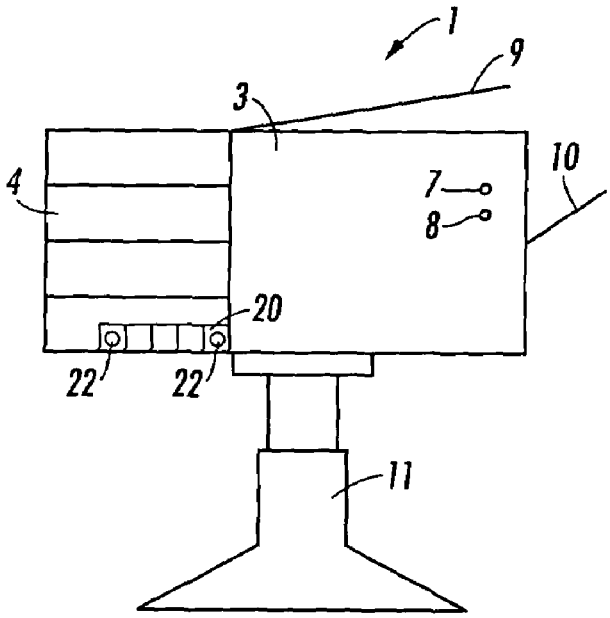
FIG. 3 illustrates a side view of a two module unit with a hydraulic lift-raise and lower adjuster with the removable panel on the lower side of the paper tray module.

In FIG. 2, an embodiment of this invention is shown where the I.O.T. module 3 and the paper tray module 4 are on the same vertical level, i.e. side by side rather than in an arrangement where the paper trays 4 are below the I.O.T. or processor module 3 as shown in the usual prior art arrangement. A raising and lower device 6, in this case a conventional or modified scissors-jack 6 connected to a motor (not shown) is used to automatically lower the entire structure to the desired level of the wheelchair occupant 2. In FIG. 2, the wheelchair user 2 is shown manipulating the removable panel 20 to control the various functions of copier 1. In this FIG. 2, the user has used the control panel to lower both modules 3 and 4. Any suitable known means may be used to automatically raise or lower the structure; a scissors-jack automatic device 6 connected to a source of power is an easy and convenient way to vertically adjust the structure 3-4. The removable panel 20 of this invention is positioned on the top or side of either or both component 3 or 4 for the use of the wheelchair occupant to automatically raise or lower the component(s) 3 and/or 4. This panel is also provided for automatic horizontal or lateral movement. In this FIG. 2 embodiment, the user can wheel around the unit to load paper in trays 4, push any suitable panel buttons, lift platen cover 9, retrieve copies from collection station 10 or do any functions heretofore difficult to accomplish. When the wheelchair user 2 is finished using the marking system, he or she can conveniently push the raise button 24 on the panel 20 to raise the unit 3-4 to its normal location as shown in FIG. 1 of co-pending application ID 20070156. While the I.O.T. 3 and the paper trays 4 are shown connected, they can be separate modules each with a removable panel(s) with its own raising and lowering device as shown in FIG. 4B. Buttons 7 and 8 can be used as an alternative to using the removable pane 20. In FIG. 2 the removable panel is shown removed from module 3. In FIG. 3 the removable panel 20 is still located in module 3 before being removed by the user.

In FIG. 3, rather than using a scissors-jack as the automatic device by the use of panel 20 to raise or lower the marking structure 1, a conventional hydraulic lift 11 connected to a source of power, can be used, if suitable. The same buttons 24 on the panel are used to raise or lower the marking structure 1. As earlier noted, any suitable vertical mover besides scissors-jack 6 or hydraulic lift 11 may be used. The important aspect is that any and all of the components that make up the marking unit 1 must be adjustable by the use of removable panel 20 by the wheelchair user to fit his or her specific and individual needs. All of the components of marking system 1 are easily accessible to user 2 by merely working the buttons on the panel 20 for the desired vertical and horizontal movement. Obviously, the desired adjustments will vary with the user. Also, by traveling around the system 1, all modules are at a level easily reached by the wheelchair user 2. Once the panel 20 is removed, this exposes receiver 31 to electronically communicate with the sensor 30. Receiver 31 is located in the space 21 formed when the panel 20 is removed. In FIG. 2, the panel 20 is originally (before removed) located in the upper side of module 3. In FIG. 3, the panel 20 is originally located at the bottom of module 4.

Figure 4A:
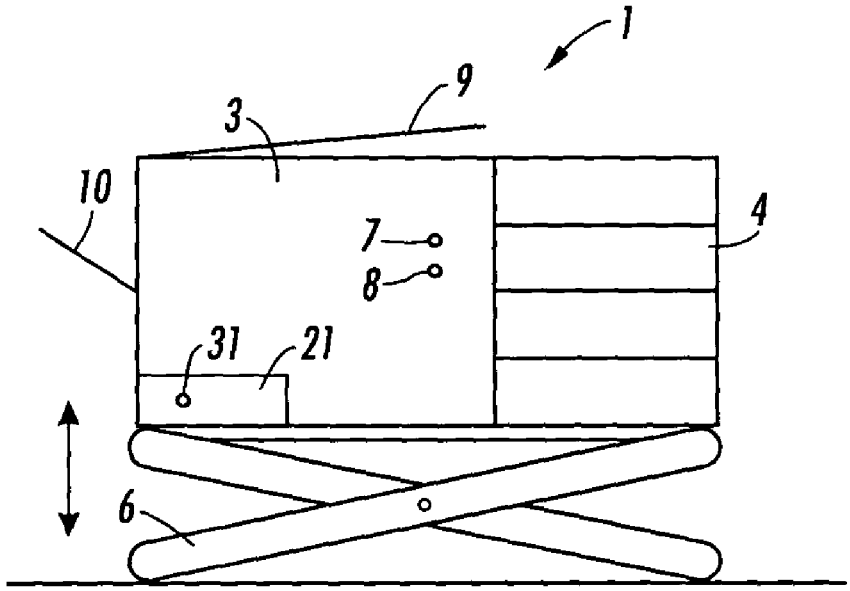
FIG. 4A illustrates a unit comprising at least two modules, an I.O.T. module and paper trays module connected with the removable panel on the lower side of the I.O.T. module.
Figure 4B:
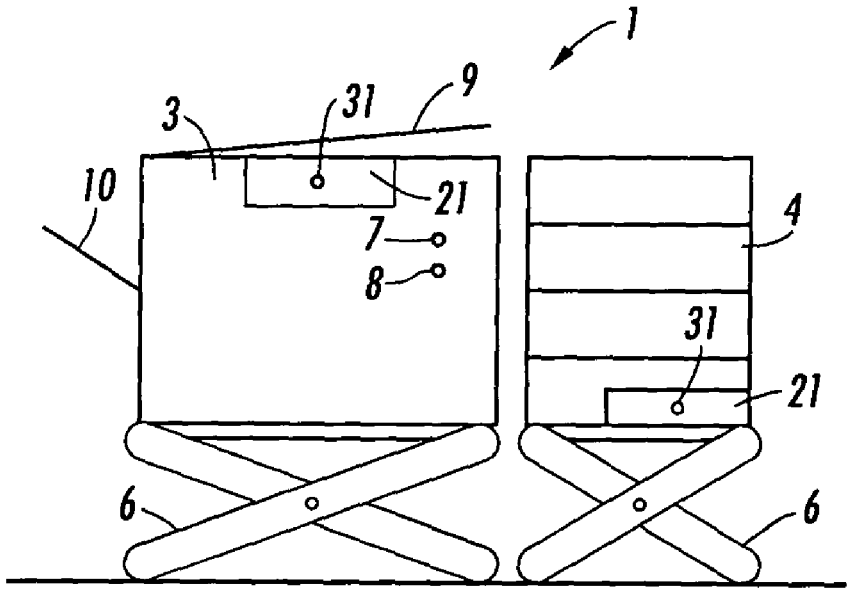
FIG. 4B illustrates a system with at least two modules, an I.O.T. module and paper tray module separated with each module having a removable panel while only one panel is required for a user. More than one user may want to also control the functions.

In FIG. 4A, a marking system 1 of this invention is shown in a side view having modules 3 and 4 connected and raised by one vertical adjuster 6. FIG. 4B shows these same modules 3 and 4 separated and provided with their own separate vertical adjusters 6.

In panel 20, means such as buttons 24 and 25 enable the panel to automatically move the raising-lowering device and the horizontally positioning device.

Figure 5A:
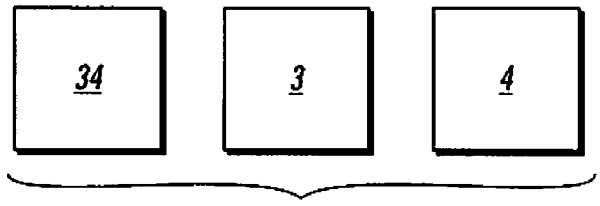
FIG. 5A illustrates an embodiment top view where at least three modules are used in the same plane.
Figure 5B:
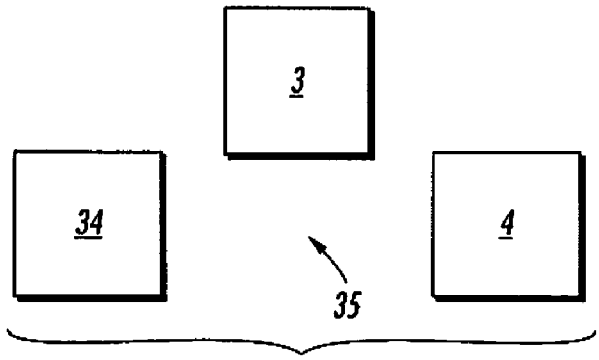
FIG. 5B illustrates an embodiment to view where at least three modules are positioned in a desk-like arrangement.
Figure 5C:
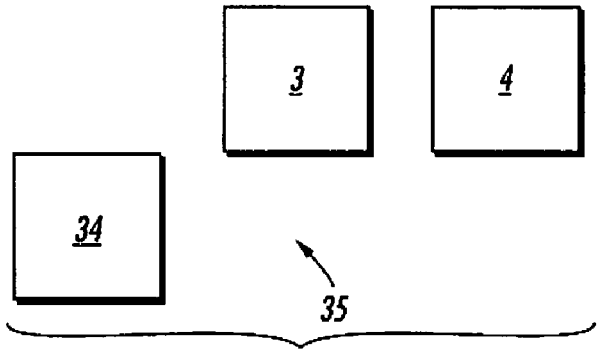
FIG. 5C illustrates a top view of at least three modules, these modules in a varied arrangement.
Figure 6:
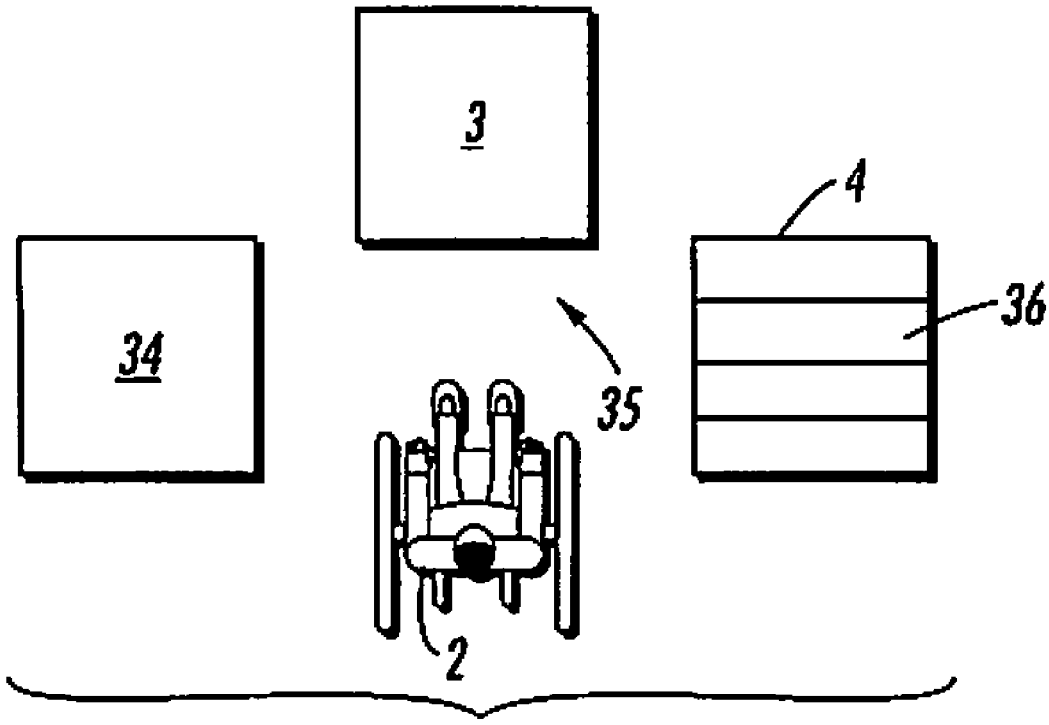
FIG. 6 illustrates a top view of the module desk-like arrangement of FIG. 5B.

When the horizontal positioning device is moved in one embodiment, the horizontal positioning device in one embodiment comprises a set of parallel retractable rails upon which each of the modules is laterally movable. In a second embodiment, the horizontal positioning device comprises powered wheels. The panel 20 permits any amount of lateral movement to occur. They should be retractable so that when moved horizontally from position to position, the rails are not extending beyond the module moved. In FIGS. 5A-5C, top views of any number of modules are shown, but at least three modules. In these Figures, three modules are shown for clarity and ease of description. The center module is designated as the I.O.T. module 3. However, the I.O.T. module can be used in any location of the modules. For these modules to function, they need to be initially separate and each have their own vertical and horizontal adjusters. Each module is enabled to be individually or collectively moved to substantially the same vertical level and to different horizontal locations as shown in FIGS. 5B, 5C and FIG. 6. It is ideal for each module to be at substantially the same desired vertical level selected by the wheelchair user. In 5A, three modules are shown from a top view, the I.O.T. is designated as center module 3, the paper trays as element 4 and element or module 34 is any module such as a finishing station (or any other functioning module.) Any number of these modules may be arranged in any suitable manner. For clarity, I.O.T. module 3 will always be shown in the center. In FIGS. 5B and 5C, a top view of a desk-like arrangement of the modules is shown with the I.O.T.-3 in the center and moved horizontally out of alignment with modules 4 and 34 leaving a space 35 between the modules into which a wheelchair can move. The modules 4 and 34 can be in horizontal alignment as shown in FIG. 5B or can be out of alignment as shown in FIG. 5C. Obviously, any number of modules can be used and arranged in any desirable fashion. If desired, in module 4, the paper trays can be moved so that the paper drawers 36 face outwardly as shown in FIG. 6 or they can face pointing inwardly toward the user 2. In FIG. 6 paper drawers 36 are not to views but are side views of 36 only for clarity. These side views of the module 4 show paper drawers 36 facing outwardly for easy access. The components other than module 4 in FIG. 6 are shown in a top view. FIG. 6 shows a top view of a desk-like modular arrangement where the wheelchair user 2 locates himself or herself in space 35 and can control each of the modules 3, 4 and 34 by push buttons or activating elements 7 and 8 on each unit 3, 4 and 34. This can be a convenient arrangement for the wheelchair user 2 because all components are conveniently positioned at arms length. As noted earlier, each of the modules 3, 4 and 34 have their own vertical adjuster 6 and horizontal adjuster 12 to place each module in any arrangement. All modules in FIG. 6 except module 4 are shown in a to view; for clarity module 4 is shown in a side view.

In summary, embodiments of this invention provide a module used in a marking apparatus comprising in an operative arrangement a module housing and a removable control panel. The housing has a space into which the removable control panel fits. The panel is enabled to be removed from said space and to remotely control various functions in the making apparatus. The panel when in operation is also enabled to move the module vertically to a level where its components are easily accessible to a wheelchair user. This removable control panel is also enabled to move the module horizontally to a location determined by said wheelchair user. Also, the removable control panel is enabled to control a plurality of functions of said module.

In other words, the removable control panel of the module is enabled to move the module both vertically and horizontally, and subsequently after these moves to control various functions of the module or modules.

In one embodiment, the module is a processor or I.O.T. module. The processor module is positioned in a side by side arrangement with a paper tray module. As shown in the drawings, the removable control panel has a remote control sensor. This sensor is enabled to be in electronic communication with a receiver in the housing. The receiver is located in any suitable portion of the housing or is adapted to be exposed when said panel is removed from the space in the housing. The removable control panel sensor and receiver are located at any convenient portion of said housing.

The marking system as a whole comprises in an operative arrangement at least two modules, a module adjuster capable of vertically moving and lowering the modules to any desired location, and a removable control panel with an electronic sensor positioned originally (before moved) in at least one of said modules. The panel when removed from said module(s) and when operational is capable of moving and controlling the adjuster in a manner whereby the module is lowered to a position convenient for a wheelchair user to have access to various functions of the at least two modules. This control panel is also enabled to automatically move the at least two modules to any desired horizontal location where they are accessible to a wheelchair user.

An embodiment has a removable control panel with separate buttons or controls enabled to move the modules in both a vertical and horizontal direction.

The panel has releases that are activated when removing said panel from the marking system. When removed, the panel in one embodiment leaves a space or void in the module(s). This space houses a receiver adapted for electronic communication with the sensor.

The embodiments define a removable control panel originally positioned in a marking apparatus. This panel is adapted to be removed from its originally positioned location. The panel is enabled to not only control functions of the marking apparatus but is also enabled to move the marking apparatus in both a vertical and a horizontal direction as disclosed in co-pending application ID 20070156. The panel has a remote control sensor in its exterior portion and the sensor is enabled when operational to be in electrical connection with a receiver in the marking apparatus. This panel has a plurality of movable buttons, each enabled to control separate major functions of the marking apparatus.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A marking system comprising in an operative arrangement, at least two modules including a processor module, a module adjuster capable of vertically moving and lowering said modules to any desired location, and a removable control panel with an electronic sensor positioned originally (before moved) in at least one of said modules, said panel when removed from said module(s) and when operational capable of moving and controlling said adjuster in a manner whereby each of said modules are lowered to a position convenient for a wheelchair user to have access to various functions of said at least two modules, and wherein said processor module is configured to be moved horizontally beyond remaining module(s) to form a desk-like structure where said processor module is positioned in front of a user and remaining modules are positioned at a side of a user, thereby forming a space for a wheelchair to locate.

2. The system of claim 1 wherein said control panel is also enabled to automatically move said at least two modules to any desired horizontal location where they are accessible to a wheelchair user.

3. The system of claim 1 whereby said modules are connected in a side by side arrangement.

4. The system of claim 1 whereby said removable control panel has separate buttons or controls enabled to move said modules in both a vertical and horizontal direction.

5. The system of claim 1 wherein said panel has releases that are activated when removing said panel from said marking system, when removed said panel leaving a space or void in said module(s), said space housing a receiver adapted for electronic communication with said sensor.

* * * * *